US005135840A

United States Patent [19]

Reuter et al.

[11] Patent Number: 5,135,840

[45] Date of Patent: Aug. 4, 1992

[54] GRANULATED PHOTOCHEMICALS

[75] Inventors: Karl-Heinz Reuter, Frechen; Heinz Meckl, Bergisch Gladbach, both of Fed. Rep. of Germany

[73] Assignee: Agfa Gevaert Aktiengesellschaft, Leverkusen, Fed. Rep. of Germany

[21] Appl. No.: 666,895

[22] Filed: Mar. 8, 1991

[30] Foreign Application Priority Data

Mar. 23, 1990 [DE] Fed. Rep. of Germany ..... 4009310

[51] Int. Cl.[5] ..... G03C 5/24

[52] U.S. Cl. ..... 430/449; 430/450; 430/451; 430/452; 430/453; 430/458; 430/461; 430/465; 430/466

[58] Field of Search ..... 430/449, 450, 451, 452, 430/453, 458, 461, 465, 466; 523/220; 528/902

[56] References Cited

U.S. PATENT DOCUMENTS

| | | | |
|---|---|---|---|
| 2,543,086 | 2/1951 | Wiitala | 430/458 |
| 2,759,823 | 8/1956 | Kridel et al. | 430/458 |
| 4,923,786 | 5/1990 | Kuhnert et al. | 430/450 |

FOREIGN PATENT DOCUMENTS

| | | | |
|---|---|---|---|
| 647409 | 12/1950 | United Kingdom | 430/458 |

*Primary Examiner*—Hoa Van Le
*Attorney, Agent, or Firm*—Connolly and Hutz

[57] ABSTRACT

Photographic processing chemicals in the form of granulates having an average particle diameter of from 150 to 3000 μm containing a polymer having a molar mass of from 6,000,000 to 14,000,000 in a quantity from 1 to 1,000 mg/kg of granulate consisting of at least 80 mol % of one or more of the monomers, acrylamide, acrylic acid and cationic monomer or mixtures of acrylamide and cationic or anionic monomer are distinguished by being easy to prepare, dust free and freely pourable.

2 Claims, No Drawings

GRANULATED PHOTOCHEMICALS

This invention relates to granulated photochemicals and to a process for their preparation.

Photograhic processing baths such as development, bleaching and fixing baths in most cases contain the necessary active ingredients in a low concentration and are therefore prepared by the user himself from water and chemical concentrates and optionally other auxiliary agents.

The concentrates should be easy to dose and not produce dust and should not require unduly high costs for packaging and transport.

The usual liquid concentrates generally used in practice for the preparation of photographic baths ready for use have the advantage over pulverulent ready made products previously used that they do not give rise to dust and provide no problems in the preparation of their solutions. The concentrates have, however, the disadvantage of containing a large weight and volume of water and entail difficulties in the disposal of bulky packaging material.

Spray or freeze dried products according to DE-OS 37 33 861 which are intended to avoid these disadvantages have, however, the disadvantage of developing a large amount of dust.

Our own attempts to reduce the amount of dust by employing certain granulating processes have been only partly successful. It has not been possible to avoid the formation of dust completely and granulation has not been able to be carried out on all processing formulations.

It was therefore an object of this invention to find means with which a wider spectrum of photographic processing chemicals could be granulated and the formation of dust could be further reduced. In addition, it was intended that the granulates should be rapidly soluble in water.

It has now been found that granulation can be carried out with excellent results by adding small quantities of a hydrophilic polymer to the solid components of photographic processing baths.

This invention therefore relates to photographic processing chemicals in the form of granulates having an average particle diameter of from 150 to 3,000 μm containing the required active and auxiliary substances, characterised in that the granulates in addition contain a polymer having a molar mass of from 500,000 to 14,000,000 in a quantity from 1 to 1,000 mg/kg of granulate, preferably from 50 to 150 mg/kg of granulate, which polymer consists of at least 80 mol % of acrylamide, acrylic acid, cationic monomer or mixtures of acrylamide and cationic or anionic monomer.

The following are examples of suitable cationic comonomers:

N-vinylbenzyl-N,N,N-trimethyl ammonium chloride,
N-benzyl-N,N-dimethyl-N-vinylbenzyl ammonium chloride,
N,N,N-trihexyl-N-vinylbenzyl ammonium chloride,
N-(3-maleimidopropyl)-N,N,N-trimethyl ammonium chloride,
N-benzyl-N-(3-maleimidopropyl)-N,N-dimethyl ammonium chloride,
N-vinyloxycarbonylmethyl-N,N,N-trimethyl ammonium chloride,
N-(3-acrylamido-3,3-dimethylpropyl)-N,N,N-trimethyl ammoniummethyl sulphate, 1,2-dimethyl-5-vinylpyridinium-methosulphate,
N-(2-hydroxy-3-methacryloyloxypropyl)-N,N,N-trimethyl ammonium chloride,
N-(2-hydroxy-3-methacryloyloxypropyl)-N,N,N-trimethyl ammonium sulphate,
N-(2-methacryloyloxyethyl)-N,N,N-trimethyl ammonium iodide,
N-(2-methacryloyloxyethyl)-N,N,N-trimethyl ammonium-p-toluene sulphonate,
N-(2-methacryloyloxyethyl)-N,N,N-trimethyl ammonium-methosulphate,
3-methyl-1-vinylimidazolium-methosulphate,
N-(2-methacryloyloxyethyl)-N,N,N-trimethyl ammonium acetate,
N-(2-methacryloyloxyethyl)-N,N,N-trimethyl ammonium bromide,
N-(2-methacryloyloxyethyl)-N,N,N-trimethyl ammonium chloride,
N-(2-methacryloyloxyethyl)-N,N,N-trimethyl ammonium fluoride,
N-(2-methacryloyloxyethyl)-N,N,N-trimethyl ammonium nitrate,
N-(2-methacryloyloxyethyl)-N,N,N-trimethyl ammonium phosphate,
1,3-bis-(dimethylamino)-isopropyl methacrylate,
4-(N,N-diethylamino)-1-methylbutyl acrylate,
2-(N,N-diethylamino)-ethyl acrylate,
2-(N,N-diethylamino)-ethyl methacrylate,
3-(N,N-diethylamino)-propyl acrylate,
N-(1,1-dimethyl-3-dimethylaminopropyl)-acrylamide,
3,6-dimethyl-3,6-diazaheptyl acrylate,
2-(N,N-dimethylamino)-ethyl acrylate,
2-(N,N-dimethylamino)-ethyl methacrylate,
N-(2-dimethylaminoethyl)-acrylamide,
N-(2-dimethylaminoethyl)-methacrylamide,
3-(N,N-dimethylamino)-propyl acrylamide,
2-(5-ethyl-2-pyridyl)-ethyl acrylate,
2-phenyl-1-vinylimidazole,
2-methyl-1-vinyl imidazole,
1-vinyl imidazole,
2-methyl-5-vinylpyridine,
2-vinylpyridine,
4-vinylpyridine, The following are examples of suitable anionic comonomers:

Aconitic acid,
2-acrylamido-2-methylpropane sulphonic acid,
3-acrylamidopropane-1-sulphonic acid,
acrylic acid,
methacrylic acid,
4-acryloyloxybutane-1-sulphonic acid,
3-acryloyloxypropionic acid,
3-acryloyloxybutane-1-sulphonic acid,
3-acryloyloxypropane-1-sulphonic acid,
4-t-butyl-9-methyl-8-oxo-7-oxa-4-aza-9-docene sulphonic acid,
α-chloro acrylic acid,
maleic acid,
chloro maleic acid,
2-methacryloyloxyethyl-1-sulphonic acid,
citric acid,
crotonic acid,
fumaric acid,
mesaconic acid,
α-methylene glutaric acid,
monoethyl fumarate,
monomethyl-α-methylene glutarate,
monomethyl fumarate, vinyl sulphonic acid,
p-styrene sulphonic acid,
4-vinylbenzyl sulphonic acid,
acryloyloxymethyl sulphonic acid,
4-methacryloyloxybutane-1-sulphonic acid,
2-methacryloyloxyethane-1-sulphonic acid,
3-methacryloyloxypropane-1-sulphonic acid,
2-acrylamidopropane-1-sulphonic acid,
2-methacrylamido-2-methylpropane-1-sulphonic acid,
3-acrylamido-3-methylbutane-1-sulphonic acid.

The following are preferred cationic or anionic comonomers:

N-vinylbenzyl-N,N,N-trimethyl ammonium chloride, N-(3-acrylamido-3,3-dimethylpropyl)-N,N,N-trimethyl ammonium-methosulphate, N-2-(methacryloyloxyethyl)-N,N,N-trimethyl ammonium-methosulphate, N-(2-methacryloyloxyethyl)-N,N,N-trimethyl ammonium chloride, 2-(N,N-dimethylamino)-ethyl acrylate, N-(2-dimethylaminoethyl)-acrylamide, 2-acrylamido-2-methylpropane sulphonic acid, 3-acrylamidopropane-1-sulphonic acid, acrylic acid and methacrylic acid.

The other monomer components may be (meth)acrylic acid ester, (meth)acrylonitrile, styrene or vinyl esters of acetic or propionic acid.

Polyacrylamide, polyacrylic acid and copolymers of acrylamide with the preferred anionic or cationic monomers in any composition are preferred.

The photographic processing chemicals may be black and white developers, colour developers, bleaching agents, fixing agents or bleach fixing agents.

These photographic processing chemicals contain the usual active and auxiliary ingredients in addition to the additive according to the invention. Details are given in the examples of practical application.

The process for the preparation of the granulates according to the invention is characterised in that active and auxiliary substances of a photographic processing bath are together ground down to a particle size below 2 mm, preferably from 0.5 to 1 mm, and then subjected to a powder agglomeration with the addition of a granulating liquid containing the copolymer defined above and finally dried under vacuum and packaged in damp-proof packages.

The granulates thus prepared are mechanically stable and uniform in particle size, dissolve rapidly, have an unlimited shelf life, form no dust and are freely pourable.

Size reduction of the solid components to particle sizes below 10 μm is normally carried out by jet milling. Powder agglomeration is preferably carried out in a fluidized bed with the addition of the granulating liquid to the particles to be agglomerated, for example the addition of 200 ml of water per kg of powder.

If it is not possible to granulate all the components of a photographic processing bath together, e.g. antioxidants and alkali donors of a colour photographic developer, the components of the developer may be granulated individually but packaged together.

If components are particularly sensitive to oxygen, grinding, granulating, drying, mixing and packaging are preferably carried out under a protective gas, e.g. nitrogen.

Colour photographic developer granulates contain anti-oxidants and alkali donors as essential components of the granulates in addition to the developer substance. These three components are preferably granulated separately. The other additives, such as water softeners, heavy metal complex formers, sodium sulphite and alkali metal halides may be granulated together with one or more of the essential components.

The colour developer compounds used may be any developer compounds which are capable, in the form of their oxidation product, of reacting with colour couplers to form azomethine or indophenol dyes. Examples of suitable colour developer compounds include aromatic compounds of the p-phenylene diamine series containing at least one primary amino group, e.g. N,N-dialkyl-p-phenylene diamines such as N,N-diethyl-p-phenylene diamine, 1-(N-ethyl-N-methanesulphonamidoethyl)-3-methyl-p-phenylene diamine, 1-(N-ethyl-N-hydroxyethyl)-3-methyl-p-phenylene diamine and 1-(N-ethyl-N-methoxyethyl)-3-methyl-p-phenylene diamine. Other suitable colour developers are described, for example, in J. Amer. Chem. Soc. 73, 3106 (1951) and in Modern Photographic Processing by G. Haist, 1979, John Wiley and Sons, New York, pages 545 et seq.

Bleaching agents contain an iron(III) complex and a rehalogenating agent.

The granulates of bleaching agent may also contain corrosion protective agents such as ammonium nitrate, complex formers such as ethylene diamino tetracetic acid (EDTA), propylene diamino tetracetic acid (PDTA), diethylenetriamino penta-acetic acid (DTPA) or nitrilotriacetic acid (NTA) and agents for adjusting the pH to the desired value, e.g. ammonium carbonate.

Examples of suitable Fe(III) complexes include the Fe(III) complexes of EDTA, PDTA, DTPA and NTA. Alkali metal and ammonium halides such as NaBr, KBr, $NH_4Br$ and NaCl are suitable rehalogenating agents.

The iron(III) complex preferably amount to 20 to 50% by weight of the finished granulate. The rehalogenating agent preferably amounts to 40 to 70% by weight of the finished granulate.

Fixatives conventionally contain a thiosulphate, e.g. ammonium or sodium thiosulphate. Complex formers such as ethylene diamino tetracetic acid and agents for adjusting to the desired pH, such as sodium carbonate, may be used as further components of the fixatives.

When bleach fixing agents are used, the bleaching agent and the fixing agent are granulated together. In that case, the addition of a rehalogenating agent is not necessary.

EXAMPLE 1

Granulation of the alkaline component of a developer for processing colour negative films.

The following chemicals are mixed together for granulating the alkaline component for 10 liters of solution of developer regenerator ready for use:

| | |
|---|---|
| potassium carbonate | 338.4 g |
| potassium hydroxide, solid | 23.0 g |
| potassium bromide | 10.5 g |
| potassium bicarbonate | 33.1 g |
| diethylenetriamino pentacetic acid | 26.0 g |
| sodium sulphite sicc. | 20.2 g |
| potassium disulphite | 21.8 g |

The mixture is broken down to a particle size of about 0.5 to 0.6 mm in an Alexander mill and granulated in the air stream of a commercial fluidized bed granulator (Strea 1—laboratory apparatus of Aeromatic, Bubendorf/Switzerland).

80 ml of water are sprayed on this mixture as granulating liquid in 3 to 4 minutes.

After granulation, the material is dried in the same apparatus by heating of the fluidization air to 60° C. for 4 to 5 minutes.

PROPERTIES

The granulate is freely pourable but contains a large amount of dust. If the dust is sieved off, new dust particles rapidly form due to the powerful abrasion.

If water is replaced as granulating liquid by a 0.05% by weight aqueous solution of polyacrylamide A, a dust free granulate characterised by an extremely small amount of abrasion is obtained. Polyacrylamide A is a polyacrylamide having an average molar mass of $7\times10^6$.

EXAMPLE 2

Preparation of a granulate for 10 liters of solution of the stabilizing bath regenerator ready for use for processing colour negative paper.

The following chemicals are mixed together and broken down to a particle size of about 0.5 to 0.6 mm in the Alexander mill:

| | |
|---|---|
| sodium sulphite sicc. | 20 g |
| sodium benzoate | 10 g |
| disodium salt of 1-hydroxyethane-1,1-diphosphonic acid | 43 g |
| calgon | 20 g |
| caustic soda | 8 g |

When attempts are made to prepare a granulate with water as spraying agent, no grains are obtained, only a few agglomerates which rapidly break down (e.g. by shaking).

If, on the other hand, a 0.05% by weight aqueous solution of acrylamide A is used (120 ml/kg of premix), a freely pourable, rapidly soluble granulate with a low dust content is obtained.

EXAMPLE 3

Two stage preparation of a bleach fixing bath granulate.

A bleach fixing bath granulate is prepared by mixing two individual granulates A and B. The following quantities of chemicals are used for 10 liters of regenerator ready for use:

| | |
|---|---|
| Granulate A: | |
| ammonium thiosulphate | 750 g |
| ammonium carbonate | 26 g |
| sodium disulphite | 135 g |
| | 911 g |
| Granulate B: | |
| ammonium-iron-EDTA | 570 g |
| EDTA acid | 8 g |
| | 578 g |

PREPARATION OF GRANULATE A

The chemicals mentioned under A are broken down to a particle size of about 1 mm in an Alexander mill and then ground to a particle size of 5 μm in an air jet mill. The ground material is then granulated in about 500 g portions in a fluidized bed granulator mentioned in Example 1 by spraying 50 ml of water as granulating liquid into the fluidized bed within about 2 minutes. The product is then dried by heating the fluidization air to 70° C. for about 6 minutes. The granules of the required particle size are separated from about 5% of undersized granules (<0.2 mm) by sieving. The product is then after-dried in a vacuum at room temperature.

PREPARATION OF GRANULATE B

When the chemicals mentioned under B have been mixed together, they are granulated in the same granulator in about 7 minutes by spraying 50% by weight ammonium-iron-EDTA solution containing excess ammonia on the mixture. 200 ml of this solution are sprayed on 600 g of mixture B at room temperature. The product is then dried by heating the fluidization air to 70° C. for 10 minutes. After removal of the oversized granules by sieving, the product is dried in a vacuum at room temperature for 3 to 4 hours.

Granulates A and B are mixed together for the preparation of the mixed granulate ready for use.

911 g of granulate A and 578 g of granulate B provide the necessary quantity of mixed granulate for 10 liters of bleach fixing bath regenerator.

EXAMPLE 4

Single stage preparation of the bleach fixing bath granulate.

The following chemicals are mixed together and broken down to a particle size of about 0.5 to 0.6 mm in an Alexander mill (for 10 liters of regenerator ready for use).

| | |
|---|---|
| ammonium thiosulphate | 750 g |
| ammonium carbonate | 26 g |
| sodium disulphide | 135 g |
| ammonium-iron-EDTA | 570 g |
| EDTA acid | 8 g |
| | 1489 g |

The ground material thus obtained is granulated in 500 g portions in a commercial Strea- fluidized bed granulator.

For this purpose, 60 ml of the 0.05% by weight aqueous solution of a 1:1 copolymer of acrylamide and acrylic acid having an average molar mass of $11.10^6$ are sprayed on the materail as granulating liquid in about 5 minutes. The product is then dried as usual by heating the fluidization air to 70° C. for 6 minutes. The granulate obtained is afterdried in a vacuum at room temperature for 3 hrs. after about 1% by weight of oversized grain has been sieved off.

A dust free, freely pourable and rapidly soluble granulate is obtained. The one stage process of Example 4 is considerably simpler than the process of Example 3.

If 60 ml of water or 60 ml of 50% by weight iron-ammonium-EDTA solution is used for the granulating process instead of the copolymer solution, the individual chemicals separate out (no homogeneous granulate) when the granulating process is carried out with water while large lumps of product are formed when the $NH_4$-Fe-EDTA solution is used. Further, heavy formation of dust is found in both cases.

EXAMPLE 5

Preparation of a fixing bath granulate.

The following chemicals are mixed in the proportions stated for the preparation of a granulate for 10 liters of regenerator solution ready for use:

| | |
|---|---|
| ammonium thiosulphate | 1400 g |
| EDTA acid | 12 g |
| sodium disulphite | 139 g |
| ammonium carbonate | 300 g |

After a preliminary size reduction in the Alexander mill, the mixture is ground to an average particle size of about 5 μm in the air jet mill.

About 700 g of this mixture per batch are granulated in the granulator used in Example 1 within 5 minutes by the spraying of 110 ml of water on the mixture. Spraying is interrupted several times to ensure a uniform grain size distribution. The granulate obtained is then dried by heating the fluidization air to 55° C. for 10 minutes. Any oversized or undersized grain obtained is sieved off. The granulate is finally dried in a vacuum at room temperature for two hours.

The granulate readily forms dust and tends to stick together.

The same mixture of chemicals as indicated above is ground to a particle size of 0.5 to 0.6 mm in the Alexander mill.

About 700 g of this mixture per batch are granulated within 3 minutes by spraying 70 ml of an 0.05% by weight aqueous solution of a copolymer of average molar mass $12\times10^6$ composed of 40% by weight of acrylamide and 60% by weight of N-vinylbenzyl-N,N,N-trimethyl ammonium chloride on the mixture. The product is then dried by heating the fluidization air to 55° C. for 5 minutes. Any oversized or undersized grain formed is sieved off and the granulate of the required particle size is dried in a vacuum at room temperature for 1.5 hours.

A dust free, freely pourable granulate which has no tendency to cake together is obtained.

We claim:

1. Photographic processing chemicals in the form of granulates having an average particle diameter of from 150 to 3,000 μm containing the required active and auxiliary substances, characterised in that the granulates in addition contain a polymer having a molar mass of from 500,000 to 14,000,000 in a quantity of from 1 to 1,000 mg/kg of granulate, which polymer consists of at least 80 mol % of acrylamide, acrylic acid, cationic monomer or mixtures of acrylamide and cationic or anionic monomer.

2. Photographic processing chemicals according to claim 1, characterised in that the polymer is polyacrylamide, polyacrylic acid or a copolymer of acrylamide and N-vinylbenzyl-N,N,N-trimethyl ammonium chloride, N-(3-acrylamido-3,3-dimethylpropyl)-N,N,N-trimethyl ammonium-methosulphate, N-2-(methacryloyloxyethyl)-N,N,N-trimethyl ammonium-methosulphate, N-(2-methacryloyloxyethyl)-N,N,N-trimethyl ammonium chloride, 2-(N,N-dimethylamino)-ethyl acrylate, 2-(N,N-dimethylamino)-ethyl methacrylate, N-(2-dimethylaminoethyl)-acrylamide, 2-acrylamido-2-methylpropane sulphonic acid, 3-acrylamidopropane-1-sulphonic acid, acrylic acid or methacrylic acid.

* * * * *